US006591765B2

(12) United States Patent
Braddock

(10) Patent No.: US 6,591,765 B2
(45) Date of Patent: Jul. 15, 2003

(54) SECURITY SYSTEM

(75) Inventor: Michael Braddock, Manchester (GB)

(73) Assignee: Secure Options Ltd., Oldham (GB)

( * ) Notice: Subject to any disclaimer, the term of this patent is extended or adjusted under 35 U.S.C. 154(b) by 0 days.

(21) Appl. No.: 09/834,756

(22) Filed: Apr. 13, 2001

(65) Prior Publication Data

US 2002/0007771 A1 Jan. 24, 2002

(30) Foreign Application Priority Data

Apr. 17, 2000 (GB) ..... 0009484

(51) Int. Cl.[7] ..... E05G 1/04

(52) U.S. Cl. ..... 109/52; 109/2; 109/5; 109/24; 109/45; 109/49.5; 312/319.6; 312/319.7

(58) Field of Search ..... 109/2, 5, 22, 23, 109/24, 45, 49.5, 52; 312/319.5, 319.6, 319.7, 319.8

(56) References Cited

U.S. PATENT DOCUMENTS

| | | | | | |
|---|---|---|---|---|---|
| 1,695,896 | A | | 12/1928 | Holden | |
| 2,775,947 | A | * | 1/1957 | Mosler | 109/47 |
| 4,455,846 | A | * | 6/1984 | Wichinsky | 70/94 |
| 4,548,060 | A | * | 10/1985 | Campbell | 70/91 |
| 4,562,708 | A | * | 1/1986 | Gros | 70/94 |
| 5,087,107 | A | * | 2/1992 | Fumanelli | 312/319.5 |
| 5,103,659 | A | * | 4/1992 | Benefield, Sr. | 70/94 |
| 5,314,244 | A | * | 5/1994 | Swets et al. | 312/330.1 |
| 5,392,951 | A | * | 2/1995 | Gardner et al. | 312/319.5 |
| 5,435,255 | A | * | 7/1995 | Elseser et al. | 109/56 |
| 5,915,802 | A | | 6/1999 | Siler | 312/216 |
| 6,047,998 | A | * | 4/2000 | Pollard et al. | 109/57 |
| 6,139,034 | A | * | 10/2000 | Williams | 280/47.35 |

FOREIGN PATENT DOCUMENTS

| | | |
|---|---|---|
| GB | 2 278 153 A | 11/1994 |
| GB | 2 302 911 A | 2/1997 |

* cited by examiner

*Primary Examiner*—Anthony Knight
*Assistant Examiner*—Christopher Boswell
(74) *Attorney, Agent, or Firm*—Fulbright & Jaworski L.L.P.

(57) ABSTRACT

An apparatus for preventing the removal of cassettes from an automated teller machine along their guide paths includes mountings and a plurality of retainers, each associated with its respective cassette. Each retainer is securable in an operational position on the mountings to extend into the guide path of its respective cassette to prevent removal of the cassette. Further, each retainer is movable from the operational position to allow removal of its respective cassette. The retainers may be removable from the mountings to allow removal of the cassette and lockable to the mountings. Two or more locking devices may be used in which the locks are operated separately or remotely. The retainer may be a suitably shaped elongate member such as a locking bar. Multiple bars can be used to retain a cassette. The retainers may guard the face of the cassette.

13 Claims, 3 Drawing Sheets

LOCKING BAR 6 REMOVED
FOR ACCESS TO DRAWER 2

SECURITY SYSTEM

This application claims priority from U.K. Application No. 0009484.7, filed Apr. 17, 2000.

BACKGROUND OF THE INVENTION

The present invention relates to apparatus for preventing the removal of cassettes from an automated teller machine.

By "automated teller machine" is meant a machine designed to dispense customer account information and cash in notes form. These machines can be positioned on external or internal walls in a wide variety of buildings such as for example banks, supermarkets, stores, airports, sporting arenas and exhibition halls.

Access to the machine by a user is available by the acceptance of a user card carrying magnetic data which is entered into the machine in the correct orientation together with the user's code number, i.e. PIN number provided manually by pressing the appropriate push buttons on the machine. As soon as the authorization is obtained, the user follows instructions on the machine screen to obtain the required cash or information. The cash is dispensed through a slot and the card is made available to the user upon completion of the transaction.

The cash is placed in cassettes which are then loaded into the machine from the rear of the machine. At the request from the user the cash is fed from the cassette through the dispensing slot by electromechanical means and in amounts corresponding to the user request. These machines carry considerable sums of cash and are therefor vulnerable to attack. The front of the machine exposed to the public is secure against all forms of attack except those using explosives or heavy machinery because the only access to the cassettes is through a slot to receive the magnetic card and a slot for dispensing the cash. However a security weakness of the machine is at the rear when the cash is being loaded into the machine.

It is customary for the rear of the teller machine to be guarded by a very strong high security door having a sophisticated locking system similar to that of a safe. Some machines also have a second door or a secondary access system in order to enhance the security in the period when the machine is being loaded with cash.

When these means of access are in the open condition to enable the cash to be loaded, the machine is vulnerable to attack because robbers can remove the cash cassettes in the machine in addition to any cassettes awaiting loading.

The method of loading the machine can be determined by the management. One method is to carry one cassette to the machine area, open the first access door followed by the second door, exchange the cassettes, lock the second door, lock the first door and return for a second cassette. This is the most secure method but it is extremely time-consuming.

Another method is to transfer all cassettes to the machine area, open the first and second doors, effect the transfer, and lock the two doors. This method is quicker than the first method, but it obviously carries a higher risk in the event of an attack.

SUMMARY OF THE INVENTION

It is an aim of the invention to reduce the disadvantages of the above-mentioned loading methods. According to the invention there is provided apparatus for preventing the removal of cassettes from an automated teller machine along their guide paths, the apparatus comprising mounting means, and a plurality of retaining means, each associated with its respective cassette, in which each retaining means is securable in an operational position on the mounting means to extend into the guide path of its respective cassette to prevent removal of the cassette, and in which each of the retaining means is movable from the operational position to allow removal of its respective cassette.

At least one of the retaining means may be removable from the mounting means to allow removal of the cassette.

Embodiments of the invention will now be described by way of example with reference to the accompanying drawings in which:

DETAILED DESCRIPTION OF THE PREFERRED EMBODIMENTS

In a first embodiment at least one of the retaining means may be lockable to the mounting means by means of a mechanical lock. If desired, two or more mechanical locking devices may be used in which the locks are operated by keys held by named individuals simultaneously or in response to a preselected sequence.

Other suitable locking systems include electromechanical or electronic locking devices operating in response to a secure control signal received by means such as a radio signal, a satellite signal, an access control signal with secondary recognition, signals from a Cash In Transit vehicle, a cellular telephone or any combination of these.

The retaining means may be a suitably shaped elongate member such as a locking bar which can be moved hydraulically, electrically by motor control, pneumatically or manually. These bars can be removed from their designated positions, and if required multiple bars can be used to retain a cassette. The retaining means may be shaped so as to guard the face of the cassette in order to provide an additional level of security.

Figures 1, 2:
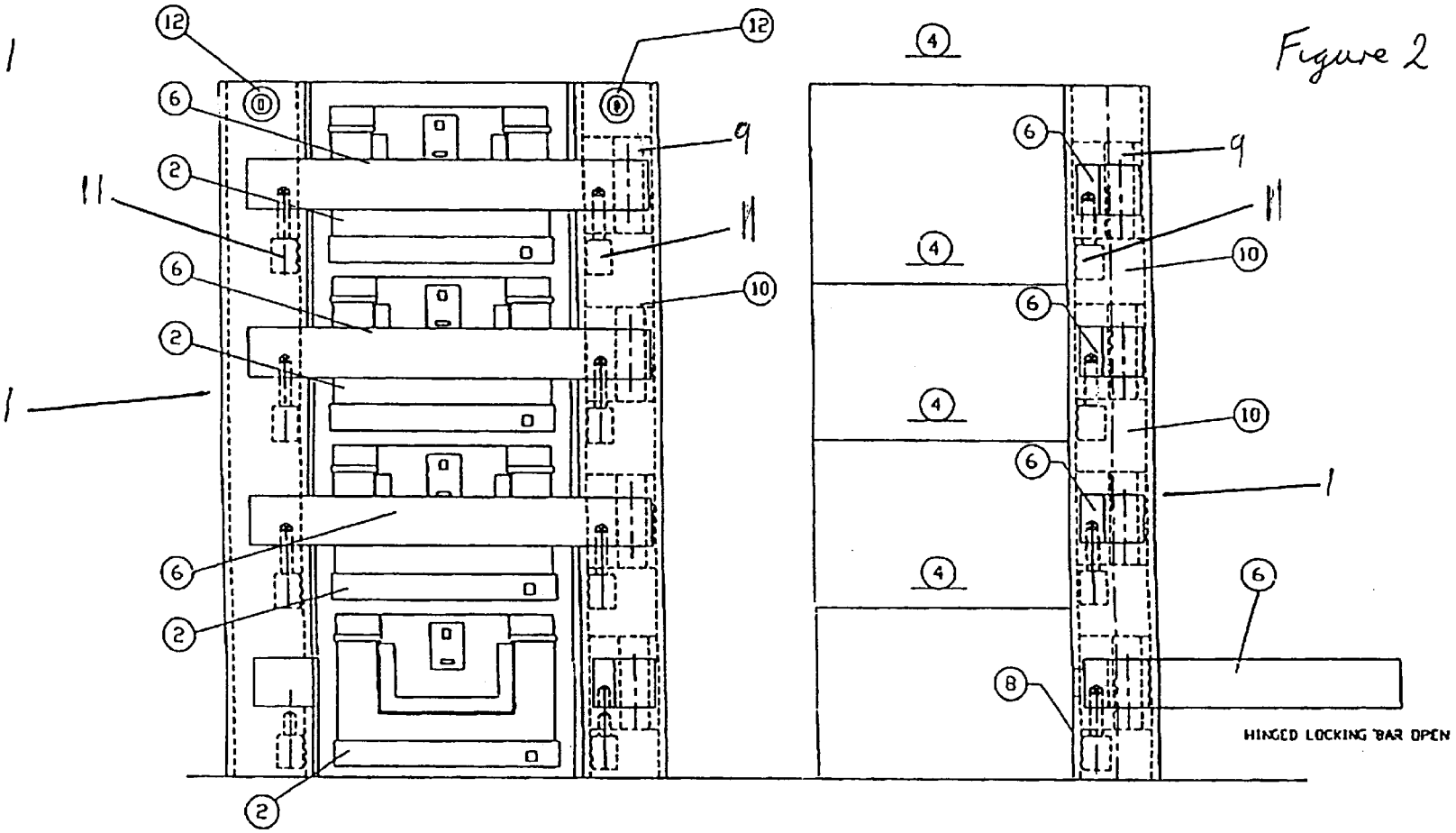
FIG. 1 is a diagrammatic rear view of an automated teller machine with the cassettes in place.
FIG. 2 is a diagrammatic side view of the automated teller machine of FIG. 1 with the cassettes removed.

Referring to FIGS. 1 and 2 an automated teller machine 1 is designed to house four cash carrying cassettes 2 which are located in their associated compartments 4 which are open at their rear ends.

Four retaining bars 6 extend across the rear ends of their respective compartments 4 adjacent to the rear faces 8 of their associated cassettes 2 to prevent unauthorized removal of the cassettes from the rear of the machine.

The retaining bars are pivotally mounted at one end to an upright mounting post 1 by means of associated hinges 9.

The retaining bars 6 are secured in their closed position as shown in FIG. 1 by locking devices 11 on both sides of each compartment 4 which may be activated by a key insertable into a lock 12.

Examples of a suitable locking device are:

(1) Conventional mechanical locks having a key copying protection which are operable individually or alternatively operable in response to a master key.

(2) Two or more mechanical locking devices arranged so that the locks have to be operated simultaneously by keys held by named individuals, either individually or in a preselected sequence.

(3) Electro-mechanical or electronic locking devices operating in response to a controlled secure signal.

(4) Electronic locking devices which act in response to a signal which could for example be a radio signal, a satellite signal, an access control signal having secondary recognition, signals from a Cash In Transit Vehicle, or a cellular telephone or any combination of the three.

The rear of the automated teller machine is protected by a substantially built high security door having a sophisticated locking system, similar to that of a safe. The machine may also have a secondary door inside the high security door in order to provide additional security from attack.

To load the machine the security door and secondary door are opened and only the cassette being loaded is brought to the machine. The appropriate locking device is then unlocked and the associated locking bar 6 is pivoted on its hinge to open the compartment 4. If an empty cassette is already in the dispensing position it is withdrawn from its compartment 4 and the full cassette is advanced into its dispensing position in the compartment 4. The retaining bar 6 is then locked into its retaining position across the rear of compartment 4, and if any other cassettes are to be replaced or loaded into the machine then the above-mentioned operation is repeated for that cassette. When all cassettes have been loaded, and the retaining bars 6 have been returned to and locked in their retaining positions the secondary door and then the high security door are locked to complete the operational security of the machine.

Figures 3, 4:
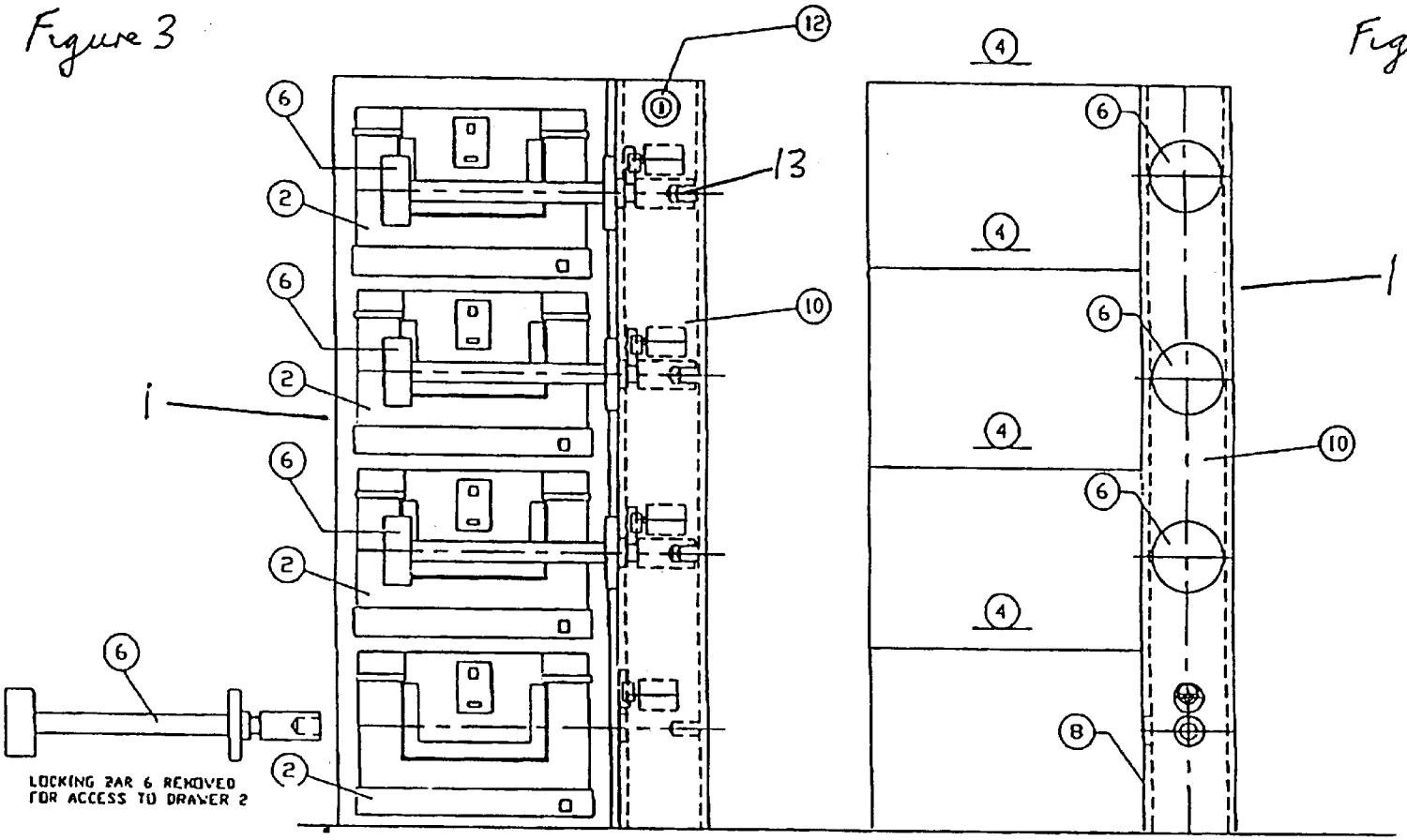
FIG. 3 is a diagrammatic rear view of another automated teller machine with the cassettes in place.
FIG. 4 is a diagrammatic side view of the automated teller machine of FIG. 3 with the cassettes removed.

FIGS. 3 and 4 illustrate another automated teller machine, and for clarity corresponding parts have been given the same reference numerals.

In this machine the retaining bars 6 are secured to the upright mounting post 10 by locking devices 13 which may be similar to the locking devices 11. In order to replace the cassette the appropriate locking device 13 is unlocked and the associated retaining bar 6 is removed from the mounting post 10. The empty cassette 2 is withdrawn from its compartment 4 and the full cassette is advanced into the dispensing position in the compartment 4. The retaining bar is then returned into position on the mounting post 10 and is locked into its retaining position by the locking device 13. These retaining bars 6 are not privotally mounted to the mounting post 10.

Figure 6:
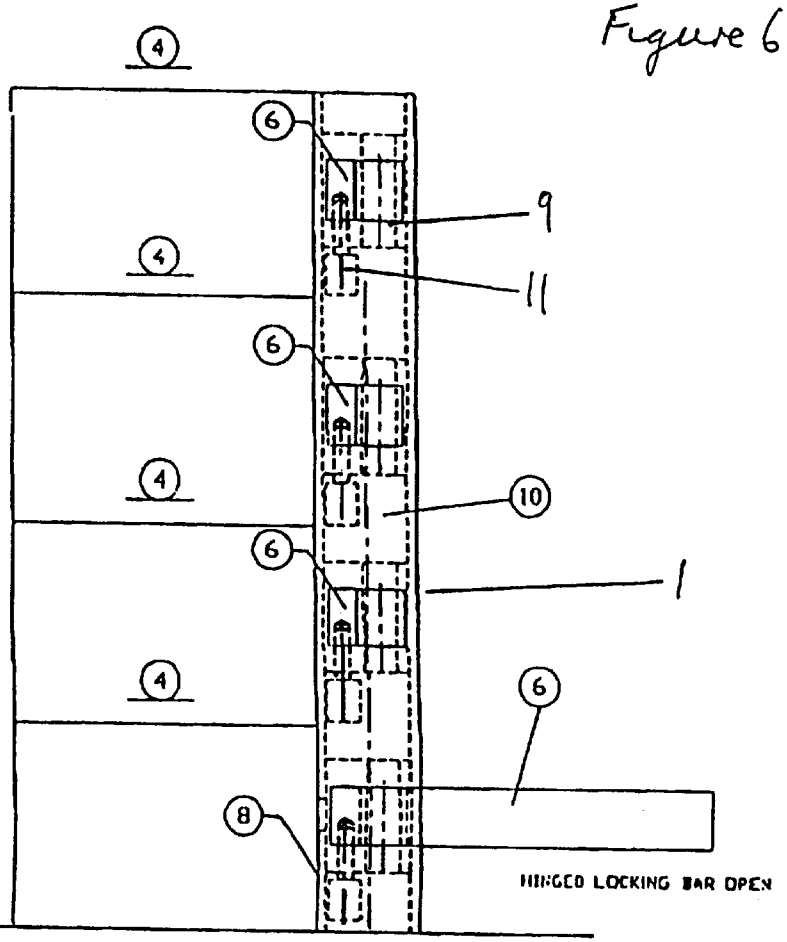
FIG. 6 is a diagrammatic side view of the automated teller machine of FIG. 5 with the cassettes removed.
Figure 5:
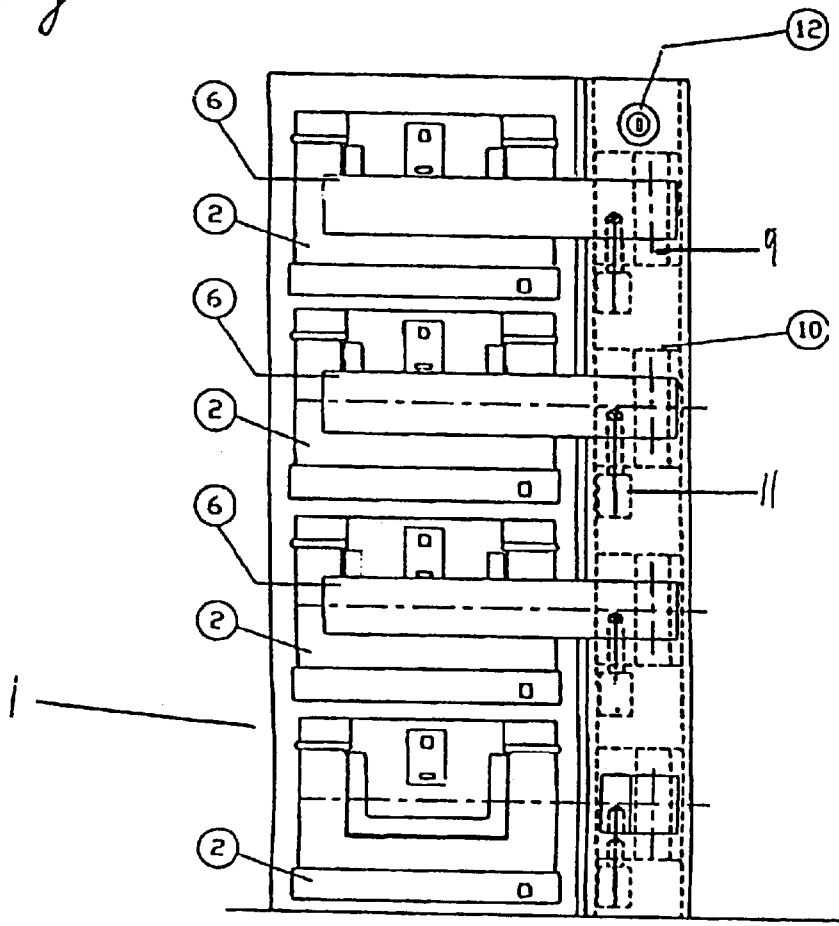
FIG. 5 is a diagrammatic rear view of a further automated teller machine with the cassettes in place.

Referring to FIGS. 5 and 6 a further automated teller machine is similar to the machine of FIGS. 1 and 2 except that the locking devices 11 are positioned only on one side of each compartment 4 adjacent to the hinges 9.

It will be appreciated that at any time during a loading or unloading operation only one cassette is not being protected by its associated retaining bar 6, and it is this feature of the apparatus which provides the improved security for the machine.

The retaining bars 6 can be designed to be locked in their retaining position without having to use the key. This reduces the time period when the cassette is vulnerable to attack, and ensures that at the time of an attack the member of staff carrying out the operation does not carry a locking release or device. The retaining bars 6 can be moved hydraulically, electrically by motor control, pneumatically or manually.

The retaining bars 6 may have any suitable shape to protect the rear faces 8 of the associated cassettes 2 from attack. For example, the bars 6 may be fin-shaped.

The apparatus may be designed so that the retaining bars 6 can be swung open only in a sequence; the time period of the sequence being controlled by a time delay. When the retaining bars 6 have been returned to their retaining positions on the mounting post 10 they cannot be reopened until after a considerably long period.

What is claimed is:

1. Apparatus for preventing the removal of cassettes along their guide paths from an automated teller machine, comprising mounting means; retaining means including a plurality of locking bars with one locking bar associated with each cassette of a plurality of cassettes, respectively, each locking bar having a locked operational position on the mounting means to extend into the guide path of the respective cassette to prevent removal of the respective cassette, and an unlocked position allowing removal of the respective cassette; and locks operable independently of one another to lock associated locking bars in the locked operational position.

2. Apparatus as claimed in claim 1, in which the locks are extendable into associated locking bars to lock the locking bars in the locked operational position.

3. Apparatus as claimed in claim 1, in which the mounting means include hinges, the locking bars being pivotally mounted by the hinges.

4. Apparatus as claimed in claim 3, in which the locks are located on the same side of the guide paths as the hinges.

5. Apparatus as claimed in claim 3, in which the guide paths are located between the locks and the hinges.

6. Apparatus as claimed in claim 1, in which the locks are operable in a preselected sequence.

7. An automated teller machine comprising guide paths; cassettes moveable along respective guide paths; mounting means fixable relative to the guide paths; retaining means including a plurality of locking members with one locking member associated with each cassette of a plurality of cassettes, respectively, each locking member having a locked operational position on the mounting means to extend into the guide path of the respective cassette to prevent removal of the respective cassette, and an unlocked position allowing removal of the respective cassette; locks operable independently from one another to lock associated locking members in the locked operational position; and a high security door mounted to move relative to the mounting means to enclose the cassette and the retaining means.

8. An automated teller machine as claimed in claim 7, in which the mounting means include hinges, the locking members being pivotally mounted by the hinges.

9. An automated teller machine as claimed in claim 8, in which the locks are located on the same side of the guide paths as the hinges.

10. An automated teller machine as claimed in claim 7, in which the guide paths are located between the locks and the hinges.

11. An automated teller machine as claimed in claim 7, in which the locks are operable in a preselected sequence.

12. A method for loading an automated teller machine having a plurality of cassettes moveable along guide paths within the machine and securable by a security door enclosing the plurality of cassettes, and locking members associate with each cassette, said method comprising opening the security door; unlocking and opening only a first of the locking members; replacing the cassette retained by the first locking member; closing and locking the first locking member; unlocking and opening only a second of the locking members; replacing the cassette retained by the opened second of the locking members; closing and locking the opened second of the locking members; and closing the security door.

13. A method as claimed in claim 12 further comprising before closing the security door, unlocking and opening only a third of the locking members; replacing the cassette retained by the opened third of the locking members; and closing and locking the opened third of the locking member.

* * * * *